United States Patent [19]

Carletta

[11] 4,433,508

[45] Feb. 28, 1984

[54] AUTOMOBILE WINDOW REGULATOR

[75] Inventor: Giuseppe Carletta, Carde', Italy

[73] Assignee: Eugenio Murtas, Turin, Italy

[21] Appl. No.: 364,324

[22] Filed: Apr. 1, 1982

[30] Foreign Application Priority Data

Apr. 3, 1981 [IT] Italy ..... 67471 A/81

[51] Int. Cl.[3] ..... E05F 11/38

[52] U.S. Cl. ..... 49/348; 49/362; 74/840

[58] Field of Search ..... 49/348, 349, 362, 352; 74/840, 841, 842, 424.7, 89.14, 89.15

[56] References Cited

U.S. PATENT DOCUMENTS 3,263,367 8/1966 Tanaka ..... 49/362 X 4,170,847 10/1979 Pickles ..... 49/362 X 4,182,078 1/1980 Bartholomew ..... 49/362 X

*Primary Examiner*—Philip C. Kannan

*Attorney, Agent, or Firm*—Paul & Paul

[57] ABSTRACT

An automobile window regulator for lowering and lifting an automobile window comprises an outwardly threaded cylindrical roller meshing with an inner thread of a rigid guide member secured to an automobile door. The roller is rotatably mounted in a movable pad secured to the window glass and embracing the guide member. A flexible control cable is secured to the center of the cylindrical roller and extends along the guide member to a crank or the like for rotation of the roller. By rotating the roller the movable pad coupled thereto is lifted or lowered to thereby lift or lower the window glass secured to the pad.

7 Claims, 5 Drawing Figures

AUTOMOBILE WINDOW REGULATOR

BACKGROUND OF THE INVENTION

This invention relates to an automobile window regulator and more particularly to an automobile window regulator actuating device.

Conventional automobile window regulators are usually of the type having a plurality of rollers or pulleys arranged in spaced relationship within the automobile door and a flexible cable passing around the pulleys and secured with one end to a lower edge of the window glass and the other end to a crank for actuating the window regulator. By rotating the actuating crank the cable is wound around a fixed pin whereby the free length of the cable is shortened and the end of the cable secured to the window glass and thus the window glass itself is lifted. The cables usually are two spaced along the length of the window glass and there is also a pair of pulleys at least adjacent the actuating crank. Thus, lifting or lowering of the window glass is effected by winding or unwinding a certain length of the cables onto or from the pulleys whereby the free length of the cables is shortened or increased.

Such conventional window regulators have the drawback that the cables and pulleys are subject to wear and when the pulleys are worn then easily get stuck and cause increased wear of the cables which then tend to stick or break with resultant failure of the window regulator.

It is an object of the present invention to overcome the aforementioned drawbacks by providing an automobile window regulator of different construction in which no cables and pulleys are used which are subject to wear and failure.

It is another object of the present invention to provide an automobile window regulator which is of simple and safe construction.

It is another object of the present invention to provide an automobile window regulator which can be actuated both manually and by means of a servomechanism.

It is a further object of the present invention to provide an automobile window regulator which is suitable for all types of automobiles at present in use.

SUMMARY OF THE INVENTION

The invention provides an automobile window regulator which comprises:

a cylindrical roller having on its outer surface a screw thread the axis of which coincides with that of the roller, and having an axial bore extending coaxially of the longitudinal axis of the roller, said bore having a flat, rectangular or elliptical cross section;

an upright rigid guide member secured to the automobile door and having an inner screw thread or, if it is thin, helically arranged teeth extending almost over its entire length for engagement with the screw thread on the outer surface of the cylindrical roller;

a movable pad formed of a pair of shells joined with their open sides along a central longitudinal plane coincident with the longitudinal central axis of movement in the guide member, the movable pad embracing the guide member and being movable axially thereof and firmly secured to the automobile window glass, and containing a recess for accommodating therein the cylindrical roller which, when the pair of shells of the pad are joined, can rotate in the recess but not move axially of the pad, with the guide member and the cylindrical roller engaging the screw thread or teeth of the guide member accommodated between the shells or jaws of the pad;

a flexible metal cable having one end connected to an actuating device of the crank type and the other end to a rotatable bushing provided below the screw thread of the guide member within the lower end thereof, the flexible metal cable being covered with a protective sheath extending from the actuating device up to the upper end of the screw thread of the guide member, the flexible cable having a flat, rectangular or elliptical cross-sectional shape over the entire length thereof corresponding to the screw thread of the guide member, the roller being provided with an axial slot of the same shape to receive the flexible cable for axially slidable but not rotary movement therein, the bushing in the lower end of the guide member below the screw thread thereof being rotatable but not shiftable in its height to keep the lower end of the flexible metal cable, or the end opposed to the actuating device, rotatably in place. The flexible metal cable may be rotated manually or by means of a servomechanism and such rotation causes rotation of the cylindrical threaded roller, the outside screw thread of which meshes with the inside screw thread of the guide member so that the threaded roller is shifted in height relative to the guide member and thereby the window glass secured to the movable pad, in which the threaded roller is rotatably mounted, is shifted in height.

DESCRIPTION OF PREFERRED EMBODIMENTS

Figure 1:
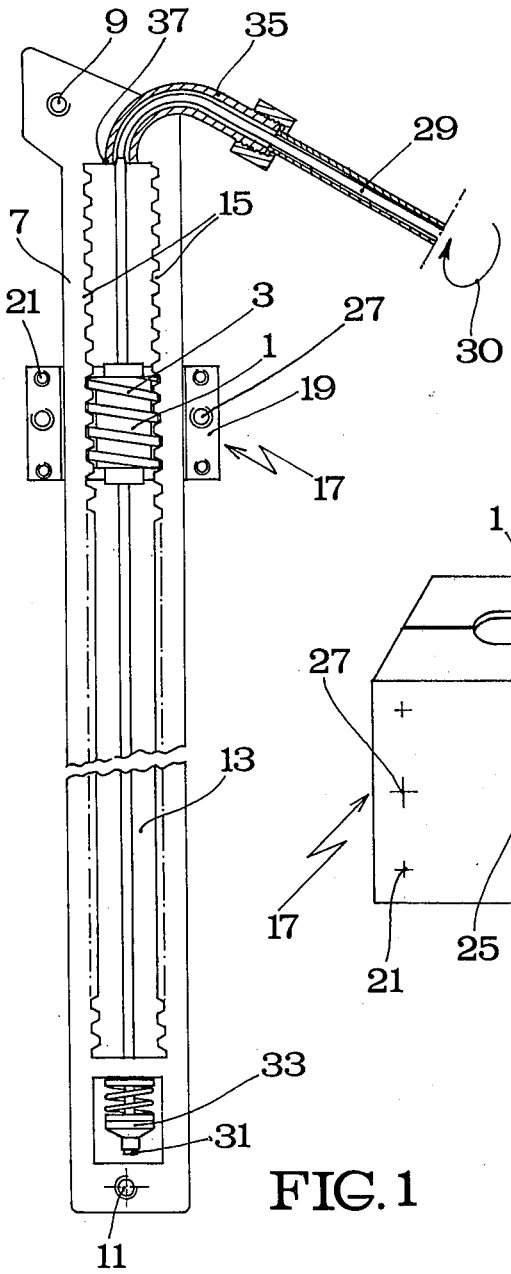
FIG. 1 is a diagrammatic part sectional view of an automobile window regulator according to the invention.

As shown in FIG. 1, an automobile window regulator according to the invention substantially comprises an outwardly threaded cylindrical roller 1 having an outer screw thread 3 the axis of which coincides with the axis of roller 1. A bore 5 having a flat, rectangular or substantially elliptical cross-sectional shape extends through roller 1 coaxially of its longitudinal axis.

An upright rigid guide member or rod 7 is firmly secured in 9 and 11 to an automobile door (not shown) and provided with a rectangular inner opening 13. A screw thread or helically arranged teeth 15 are provided along the side edges of the inner opening 13 to mesh with screw thread 3 on roller 1. Guide member 7 acts as a nut screw containing screw thread 15 in its interior, screw thread 15 being cut out of the thickness of guide member 7 and formed of a pair of close set parallel series of helically inclined teeth, extending parallel to each other and the axis of the nut screw. Thus considered, this nut screw is a rod having a rectangular cross section, as described above.

A movable pad 17 formed by a rectangular block is mounted on the outside of guide member or rod 7 and comprises a pair of centrally joined shells or jaws. In the illustrated embodiment pad 17 is formed by a pair of shells interconnected by conventional fastening means such as screw bolts 21 or the like. A substantially rectangular groove 23 extends centrally and longitudinally through pad 17 and has a shape mating the outer cross-sectional shape of guide member 7. A pair of semicircles 25 is formed in the longitudinal center of groove 23 to mate the outside diameter of the core of roller 1. Roller 1 is accommodated in pad 17 and rotatable therein but cannot shift axially as pad 17 has upper and lower edges forming shoulders preventing such axial shifting.

Figure 2:
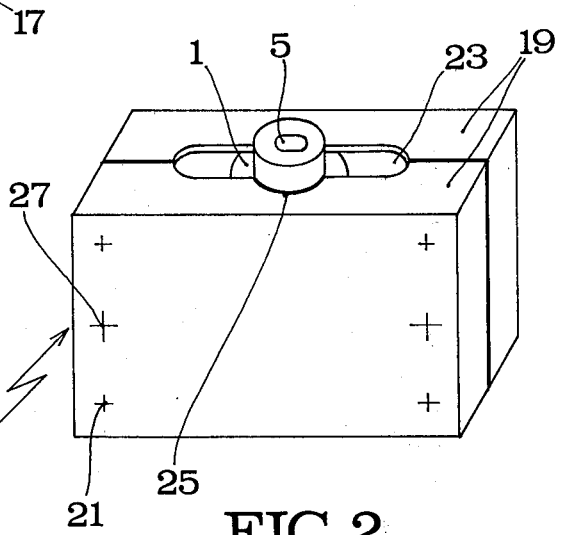
FIG. 2 is a perspective view showing the movable pad and cylindrical roller incorporated in the window regulator of FIG. 1.

The perspective view of FIG. 2 shows pad 17 and roller 1 mounted therein. Once roller 1 is mounted in pad 17, the latter is mounted on guide member 7 so as to embrace its outside. The automobile window glass is secured to pad 17 in 27. Thus lifting and lowering of pad 17 causes corresponding lifting and lowering of the window glass.

Rotation of roller 1 for actuation of the window regulator is produced by a flexible metal control cable 29 of the type of the inner wire commonly used in a mileage indicator. One end of control cable 29 is connected to a rotary actuating device 30 such as a crank or the like (not shown) and the other end to a rotatable bushing 33 mounted below the screw thread 15 of guide member 7. The flexible control cable 29 is covered with a protective sheath 35 extending from the rotary actuating device 30 to the upper end 37 of guide member 7. The length of cable 29 between upper end 37 of guide member 7 and the point of mounting 31 of rotatable bushing 33 is squeezed or otherwise made flat in cross section to produce a rectangular, elliptical or square shape corresponding to that of bore or slot 5 which is located axially in roller 1 and is likewise flat, rectangular or elliptical so that cable 29 inserted in slot 5 is axially movable but not rotatable therein.

The rotary movement imparted to flexible control cable 29 by rotary actuating device 30 may be produced manually or by means of an appropriate servomechanism (not shown) such as a servomotor or an auxiliary motor and causes rotation of roller 1 the screw thread of which meshes with the screw thread of guide member 7. Rotation of roller 1 causes it to move upwardly or downwardly with consequent upward or downward movement of pad 17 and the window glass secured thereto.

Figure 3:
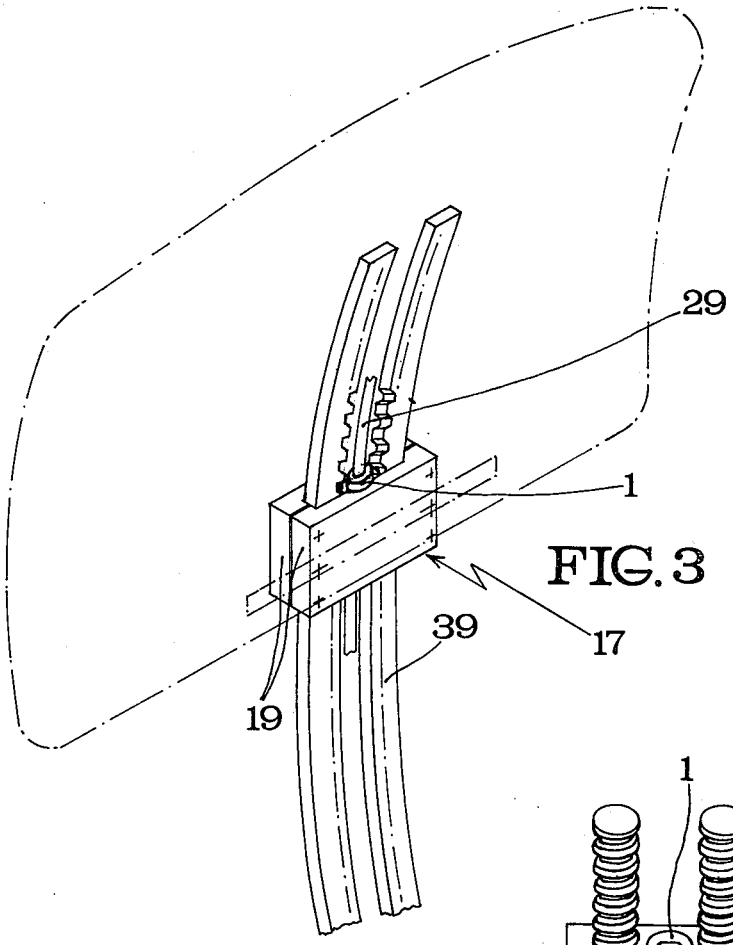
FIG. 3 is a diagrammatic perspective view of another embodiment of automobile window regulator, suitable for regulating curved window glasses.

FIG. 3 shows another embodiment having a curved guide rod 39 for application to automobiles having curved window glasses.

Figure 5:
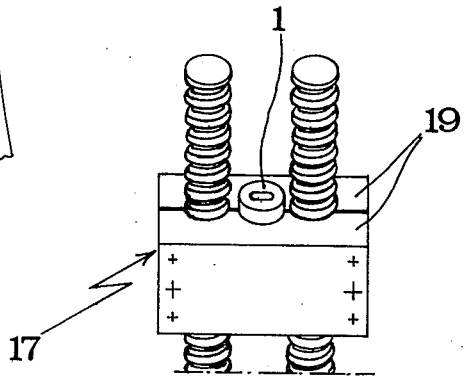
FIGS. 4 and 5 are diagrammatic perspective views of two further embodiments relating to the engagement between the cylindrical roller and the guide member.
Figure 4:
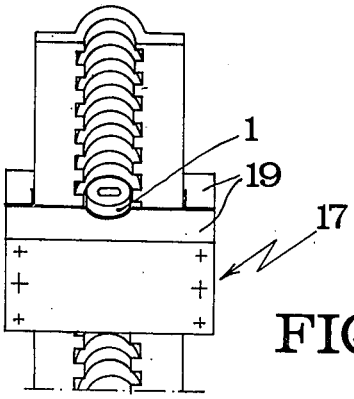

FIGS. 4 and 5 show further embodiments of the nut screw guide member and threaded lifting roller meshing therewith in the same manner as in the embodiment of FIG. 1.

Although a preferred embodiment with some modifications of the invention have thus been described in detail and illustrated in the accompanying drawings, it is to be understood that the invention is not limited to this precise embodiment and that numerous changes and modifications obvious to one skilled in the art may be made therein without thereby departing from the scope of the invention as defined by the appended claims.

I claim:

1. An automobile window regulator comprising: a cylindrical roller having on its outer surface a screw thread the axis of which coincides with that of the roller, and having an axial bore extending coaxially of the longitudinal axis of said roller; an upright rigid guide member secured to an automobile door and having inner screw thread means extending almost over its entire length for engagement with said screw thread on said outer surface of said cylinder roller; a movable pad formed of a pair of shells joined with their open sides along a central longitudinal plane coincident with a longitudinal central axis of said guide member, said movable pad embracing said guide member and being movable axially thereof and firmly secured to an automobile window glass and containing a recess for accommodating therein said cylindrical roller, said cylindrical roller being rotatable in said recess but not movable axially of said pad, said guide member and said cylindrical roller meshing with said inner screw thread means of said guide member being accommodated between said pair of shells of said movable pad; a flexible metal control cable having one end connected to a rotary actuating device and an opposite end to rotary mounting means provided below said inner screw thread means in said guide member within a lower end thereof, said flexible metal control cable being covered with a protective sheath extending from said rotary actuating device to an upper end of said inner screw thread means in said guide member; said bore in said cylindrical roller having a cross-sectional shape adapted to prevent rotation of said flexible metal control cable in said cylindrical roller in the entire portion of said flexible metal control cable corresponding to said inner screw thread means in said guide member, said cylindrical roller being provided with an axial slot of the same shape to receive said flexible metal control cable for axially slidable but not rotary movement therein; said rotary mounting means in said lower end of said guide member below said inner screw thread means thereof being rotatable but not shiftable in its height to keep said opposite end of said flexible metal control cable rotatably in place.

2. An automobile window regulator as claimed in claim 1, wherein said axial bore in said cylindrical roller and said flexible metal control cable in the portion thereof corresponding to said inner screw thread means in said guide member have a flat cross-sectional shape.

3. An automobile window regulator as claimed in claim 1, wherein said axial bore in said cylindrical roller and said flexible metal control cable in the portion thereof corresponding to said inner screw thread means in said guide member have an elliptical cross-sectional shape.

4. An automobile window regulator as claimed in claim 1, wherein said flexible metal control cable is rigid in the portion thereof corresponding to said inner screw thread means in said guide member.

5. An automobile window regulator as claimed in claim 1, wherein said rotary mounting means below said inner screw thread means in said guide member is a rotatable bushing.

6. An automobile window regulator as claimed in claim 1, wherein said rigid guide member secured to said automobile door is curved in its longitudinal direction to conform to curved automobile window glasses.

7. An automobile window regulator as claimed in claim 1, wherein said rigid guide member secured to said automobile door and having inner screw thread means in engagement with said screw thread on said outer surface of said cylindrical roller has a curved cross-sectional shape to permit smooth meshing engagement between said screw thread on said outer surface of said cylindrical roller and said inner screw thread means in said rigid guide member.

* * * * *